US006750856B2

(12) United States Patent
Shimamoto

(10) Patent No.: US 6,750,856 B2
(45) Date of Patent: Jun. 15, 2004

(54) DISPLAY SYSTEM AND INFORMATION PROCESSING APPARATUS

(75) Inventor: Hajime Shimamoto, Ome (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 281 days.

(21) Appl. No.: 09/955,033

(22) Filed: Sep. 19, 2001

(65) Prior Publication Data

US 2002/0036651 A1 Mar. 28, 2002

(30) Foreign Application Priority Data

Sep. 25, 2000 (JP) ..... 2000-291302

(51) Int. Cl.[7] ..... G09G 5/00
(52) U.S. Cl. ..... 345/204; 345/214
(58) Field of Search ..... 345/204, 132, 345/100, 150, 205, 208, 211, 212, 213, 98, 87; 340/289

(56) References Cited

U.S. PATENT DOCUMENTS 5,192,945 A * 3/1993 Kusada ..... 345/88
5,986,641 A 11/1999 Shimamoto ..... 345/150
6,020,874 A * 2/2000 Kurihara ..... 345/699
6,147,672 A * 11/2000 Shimamoto ..... 345/589

FOREIGN PATENT DOCUMENTS

WO WO98/07272 2/1998

* cited by examiner

*Primary Examiner*—Vijay Shankar
*Assistant Examiner*—Nitin Patel
(74) *Attorney, Agent, or Firm*—Finnegan, Henderson, Farabow, Garrett & Dunner, L.L.P.

(57) ABSTRACT

A signal generated by a display controller is divided into a plurality of signal groups comprising a display data signal, a control signal, and a clock signal. The divided signals are transmitted to a panel controller via channels that are different with each signal group, and adjustment of a skew generated between signal groups is executed with respect to the control signal as well.

15 Claims, 3 Drawing Sheets

DISPLAY SYSTEM AND INFORMATION PROCESSING APPARATUS

CROSS-REFERENCE TO RELATED APPLICATIONS

This application is based upon and claims the benefit of priority from the prior Japanese Patent Application No. 2000-291302, filed Sep. 25, 2000, the entire contents of which are incorporated herein by reference.

BACKGROUND OF THE INVENTION

1. Field of the Invention

The present invention relates to a high resolution panel display system.

2. Description of the Related Art

In recent years, with advancement of a personal computer, a display unit can be displayed with a variety of resolutions. Typical display modes include, for example, a VGA mode (640 dots×480 lines), an SVGA mode (800 dots×600 lines) and an XGA mode (1024 dots×768 lines). In addition, an SXGA mode with high resolution (1280 dots×1024 lines, an SXGA+ mode (1400 dots×1050 lines), a UXGA (1600 dots×1200 lines) and the like is employed.

As the resolution increases, an increased amount of information is transferred to a display controller to a display panel. As a result, there is a tendency that a frequency of a display clock signal becomes high, and the number of interface signal lines between a display controller and a display unit increases. In general, a signal line consisting of a connector and hardness is used for this interface signal line.

In the case where a high resolution display is achieved in such a circumstance, for example, the following two problems may occur. A first problem is that properly transferring display data at a high clock frequency, i.e., proper timing acquisition is difficult from the viewpoint of a setup time, a hold time or the like. A second problem is that data is transferred at a comparatively high voltage (about 5V at TTL), and thus, the periphery may be affected by electric wave irradiation.

In order to solve these problems, for example, in Japanese Patent Application No. 7-285999, there is disclosed a display interface system in which two LVDSs (Low-voltage Differential Signaling) are provided at a computer main frame and a flat panel, respectively, and irradiation of electromagnetic waves and the number of signal lines are reduced. In the system, any one of control signals by the two LVDSs. In this system, as long as a display with a certain degree of resolution is achieved, there is a low probability that a skew occurs with respect to the control signals of the two LVDSs. Thus, this can be an effective display interface system.

However, in the case of executing a further display with high resolution caused by an SXGA mode (1280 dots×1024 lines), SXGA+ mode (1400 dots×1050 lines), a UXGA mode (1600 dots×1200 lines) or the like, there is a possibility that a skew between the above described two LVDSs becomes a large problem. This is because, in the case of executing a display with high resolution, a clock frequency becomes high, and there is a higher possibility that a skew occurs between these two LVDSs than conventionally.

The present invention has been made in order to solve the foregoing problem. It is an object of the present invention to provide a panel display system with high resolution and an information processing apparatus for reducing a skew with a transmission LVDS for displaying a panel with high resolution in particular.

BRIEF SUMMARY OF THE INVENTION

According to a first aspect of the present invention, there is provided a display system comprises a display device; a generator configured to generate an image data signal that is a parallel signal of plural bits and a control signal concerning horizontal synchronization and vertical synchronization; a first transmission device which converts part of the image data signal into a first serial signal and transmits the first serial signal and a first control signal corresponding to the part of the image data signal from the generator to the display device; and a second transmission device which converts the rest of the image data signal into a second serial signal and transmits the second serial signal and a second control signal corresponding to the rest of the image data signal from the generator to the display device; wherein the display device converts the first serial signal into the part of the image data signal and the second serial signal into the rest of the image data signal, and adjusts a skew between the part of image data signal and the rest of the image data signal based on the first and second control signals.

According to a second aspect of the present invention, there is provided a display system comprises: a display device; a generator configured to generate an image data signal that is a parallel signal of plural bits and a parallel control signal concerning horizontal synchronization and vertical synchronization; a first transmission device which converts part of the image data signal into a first serial image data signal and a first control signal corresponding to the part of the image data signal into a first serial control signal, and transmits the first serial image data signal and first serial control signal from the generator to the display device; and a second transmission device which converts the rest of the image data signal into a second serial image data signal and a second control signal corresponding to the rest of the image data signal into a second serial control signal, and transmits the second serial image data signal and second serial control signal from the generator to the display device; wherein the display device converts the first serial image data signal into the part of the image data signal, the second serial image data signal into the rest of the image data signal, the first serial control signal into the first control signal corresponding to the part of the image data signal and the second serial control signal into the second control signal corresponding to the rest of the image data signal, and adjusts a skew between the part of image data signal and the rest of the image data signal based on the first and second control signals.

According to a third aspect of the present invention, there is provided a information processing apparatus comprises: a generator configured to generate an image data signal that is a parallel signal of plural bits and a control signal concerning horizontal synchronization and vertical synchronization; a first transmission device which converts part of the image data signal into a first serial signal and transmits the first serial signal and a first control signal corresponding to the part of the image data signal from the generator to a display device; and a second transmission device which converts the rest of the image data signal into a second serial signal and transmits the second serial signal and a second control signal corresponding to the rest of the image data signal from the generator to the display device.

With such configuration, there can be provided a panel display system with high resolution and an information processing apparatus that reduce a skew at a transmission LVDS.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
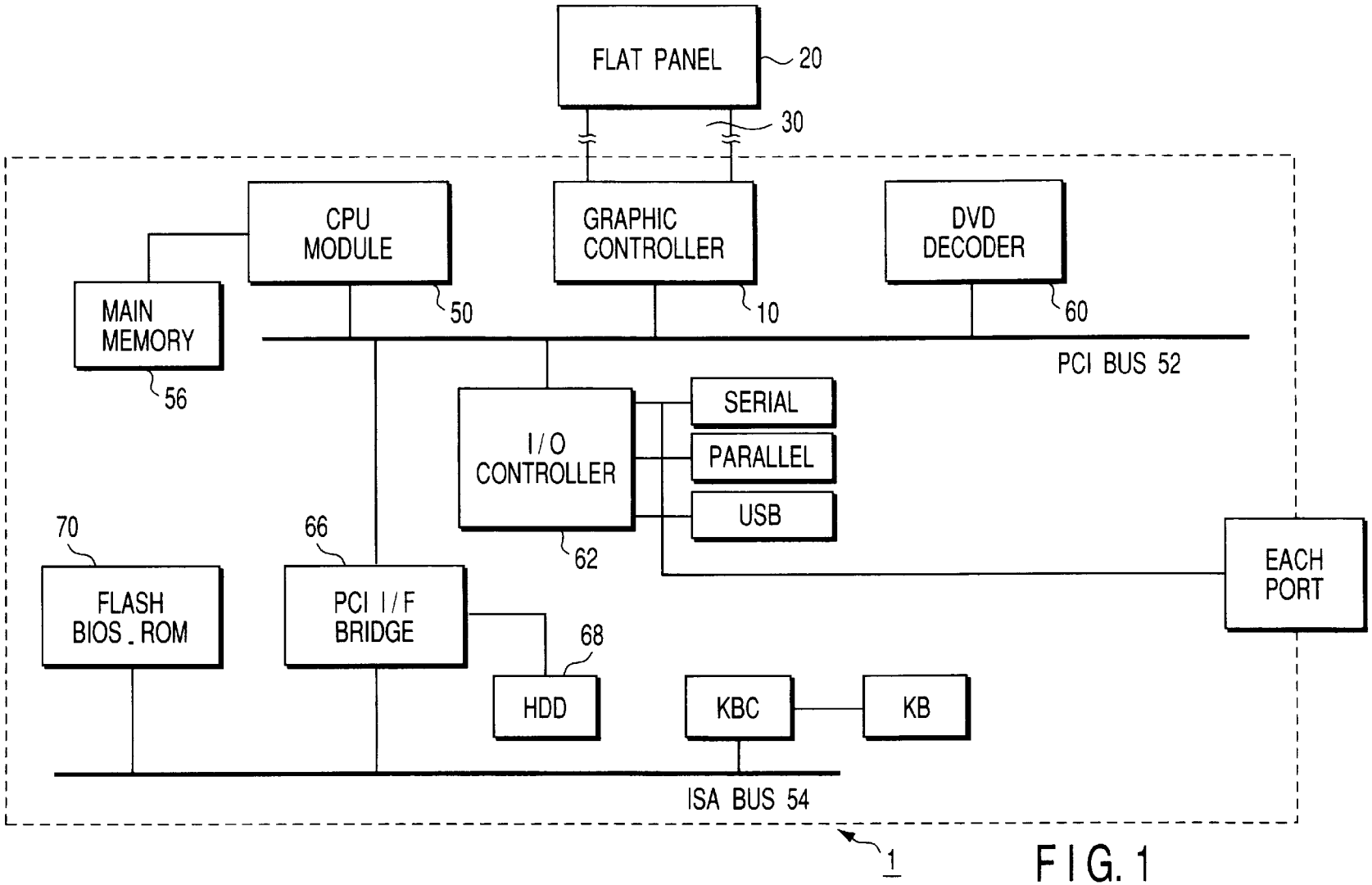
FIG. 1 is a system block diagram depicting a computer that comprises a display system according to the present embodiment.

Hereinafter, embodiments of the present invention will be described with reference to the accompanying drawings. In the following description, like elements having the substantially identical functions and configuration are designated by like reference numerals. A duplicate description will be given only when necessary.

FIG. 1 is a system block diagram depicting a computer that comprises a display system according to the present invention.

In FIG. 1, a computer 1 includes a CPU module 50, a PCI bus 52, an ISA bus 54, a main memory 56, a DVD decoder 60, an I/O controller 62, a PCI interface bridge 66, a hard disk drive HDD 68, a flash BIOS_ROM 70, a graphic controller 10, a flat panel harness 20, and a flat panel 30.

The CPU module 50 executes operation control of the entire computer system and data processing. This module 50 incorporates a controller or the like for controlling a CPU, a cache, and the main memory 56.

The main memory 56 functions as a main storage device of this computer system. The main memory 56 stores an operating system, an application program targeted for processing, and data or the like generated based on the application program.

The I/O controller 62 is a gate array for controlling a variety of I/O devices that the main frame of the computer 1 incorporates. This controller carries out controls concerning input/output of a device connected to a variety of I/O connectors such as a serial port, a parallel port, and a USB port shown in FIG. 1.

The PCI interface bridge (PCI I/F) 66 is a gate array achieved by one chip LSI. This PCI I/F 66 includes a bridge function for making connection between the PCI bus 52 and the ISA bus 54 in a bi-directional manner and a function for controlling the HDD 68 or the like.

The flash BIOS_ROM 70 is a program rewrite enable flash memory, and stores a system BIOS. The system BIOS systemizes a function execution routine for accessing a variety of hardware components in this computer system.

The graphic control 10 is an LSI with a depicting function that supports VGA (Video Graphics Array) (640 dots×480 lines), SVGA (800 dots×600 lines), XGA (1024 dots×768 lines), SXGA (1280 dots×1024 lines), UXGA (1600 dots×1200 lines) and the like.

The flat panel 20 is a display device for displaying an image based on a control signal or an image data signal from the graphic controller 10. A display system composed of this flash panel 20 and the graphic controller 10 is one of the features of the present invention, and has a configuration as described later.

The flat panel harness 30 is a serial transmission cable for transmitting image data from a main frame of the computer 1 to the flat panel 20.

Now, a block configuration of a display system according to the present invention will be described with reference to FIG. 2. This display system is a system composed of a flat panel 20, a graphic controller 10, and a flat panel harness 30, as described above, and is one of the essential parts of the present invention.

Figure 2:
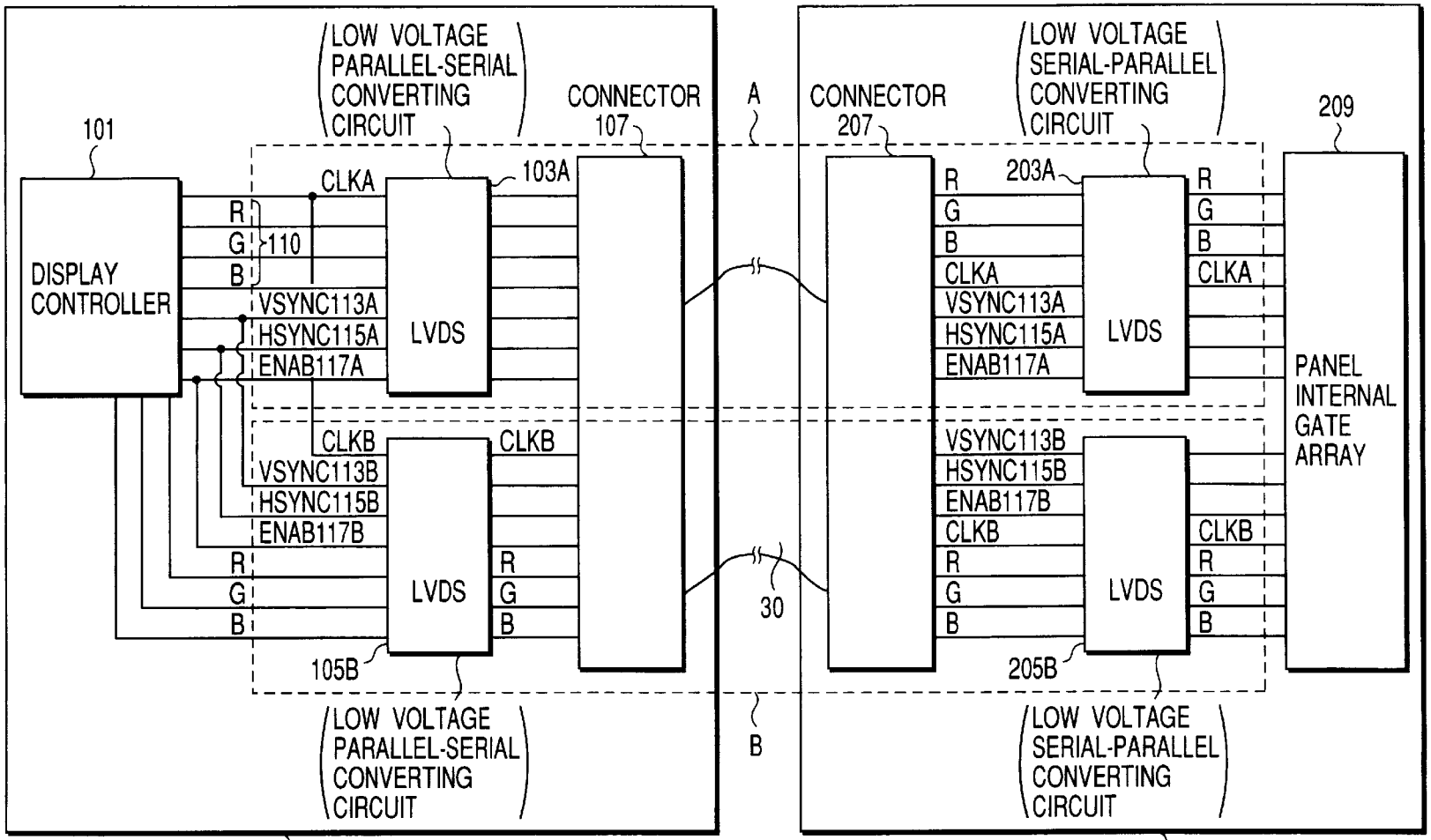
FIG. 2 is a block diagram depicting this display system, where constituent elements are described.

FIG. 2 is a block diagram depicting this display system. Hereinafter, constituent elements will be described.

(Graphic Controller Side)

A graphic controller 10 includes a display controller 101, a first LVDS-IC 103A, a second LVDS-IC 105B, and a system connector 107.

The display controller 101 outputs a digital display signal 100 (8-bit digital signals R, G, and B) displayed on a flat panel display such as a liquid crystal display device (LCD), a display clock signal 111 (hereinafter, referred to as a CLK signal 111), a VSYNC signal 113 that is a vertical synchronization signal corresponding to one screen cycle, an HSYNC signal 115 that is a horizontal signal corresponding to one line cycle, and an ENAB signal 117 for determining a data location to be divided into a first LVDS-IC 103A and a second LVDS-IC 105B at a back stage. In the following description, all signals indicating these VSNC signal 113, HSYNC signal 115, and ENAB signal 117 each are referred to as a "control signal".

The first LVDS-IC 103A and second LVDS-IC 105B each are ICs for converting the current data into LVDS (Low Voltage Differential Signaling) data by employing a multiple-bit CMOS/TTL level signal. It is preferable that the potential of each signal that is voltage-reduced at each LVDS is less than about 1 volt from the viewpoint of reducing an occurrence of electromagnetic irradiation.

The first LVDS-IC 103A inputs a digital display signal 110A that is part of the digital display signal 110 from the display controller 101, and converts the inputted signal into a low voltage analog serial signal. In addition, the first LDVS-IC 103A converts into a low voltage analog serial signal each of partial CLK signal 111A, VSYNC signal 113A, HSYNC signal 115A, and ENAB signal 117 of the signals each according to the digital display signal 110A out of the VSYNC signal 113, HSYNC signal 115, and ENAB signal 117 outputted from the display controller 101. Further, the first LVDS-IC 103A converts the display clock signal 111 into a low voltage clock signal. Each signal is outputted to a flat panel side via a system connector 107 at the PC main frame side.

The first LVDS-IC 105B inputs a digital display signal 110B composed of the residual portion of the digital display signal 110 from the display controller 101, and converts the inputted signal into a low voltage analog serial signal. In addition, the first LVDS-IC 105B converts into a low voltage analog serial signal each of partial CLK signal 111B, VSYNC signal 113B, HSYNC signal 115B, and ENAB signal 117B of the signals each according to the digital display signal 110B out of the VSYNC signal 113, HSYNC signal 115, and ENAB signal 117 outputted from the display controller 101. Further the first LVDS-IC 103A converts a display clock signal 111 into a low voltage clock signal. Each signal is outputted to the flat panel side via the system connector 107 at the PC main body side.

The system connector 107 is a connector for outputting a variety of signals from the graphic controller 10 to the flat panel 20.

(Flat Panel Side)

A flat panel 20 includes a second LDVS-IC 203A, a second LVDS-IC 205B, a panel connector 207, and a panel control gate array 209.

The second LVDS-IC 203A and the second LVDS-IC 205B are composed of CMOS. These ICs each convert analog serial signals R, G, and B each received via a panel connector 207 and a variety of drivers (not shown) into a parallel digital signal of 8 bits, converts the received analog serial control signal into its original digital control signal, and outputs the converted signal to a panel control gate array 209.

That is, the second LVDS-IC 203A converts a low voltage analog serial signal inputted via a flat panel harness 30 into a variety of digital signals (a digital display signal 110A, a CLK signal 111A, a VSYNC signal 113A, an HSYNC signal 115A, and an ENAB signal 117). In addition, the second LVDS-IC 203A voltage-increases an inputted low voltage clock signal, and converts the voltage-increased signal into a display clock signal 111A. Each signal is outputted to the flat panel side via the system controller 107 at the PC main frame side.

In addition, the second LVDS-IC 205B converts an inputted low voltage analog serial signal via the flat panel harness 30 into a variety of digital signals (a digital display signal 110B, a CLK signal 111B, a VSYNC signal 113B, an HSYNC signal 115B, and an ENAB signal 117B). Further, the second LVDS-IC 205B voltage-increases an inputted low voltage clock signal, and converts the voltage-increased signal into a display clock signal 111B. Each signal is outputted to the flat panel side via the system connector 107 at the PC main frame side.

The panel control gate array 209 drives a variety of drivers (not shown) with individual timing signals based on the display signal (R, G, B), control signal, and CLK signal received from the second LVDS-IC 203A and the second LVDS-IC 205B, and output the read display data on an LCD panel.

In addition, the panel control gate array 209 is provided with an adjusting mechanism for adjusting a skew (time-based signal deviation) of the display signal 110B and control signal B (i.e., a CLK signal 111B, a VSNC signal 113B, an HSYNC signal 115B, and an ENAB signal 117B) relevant to the display signal 110A and control signal A (i.e., a CLK signal 111A, a VSYNC signal 113A, an HSYNC signal 115A, and an ENAB signal 117A).

Figure 3:
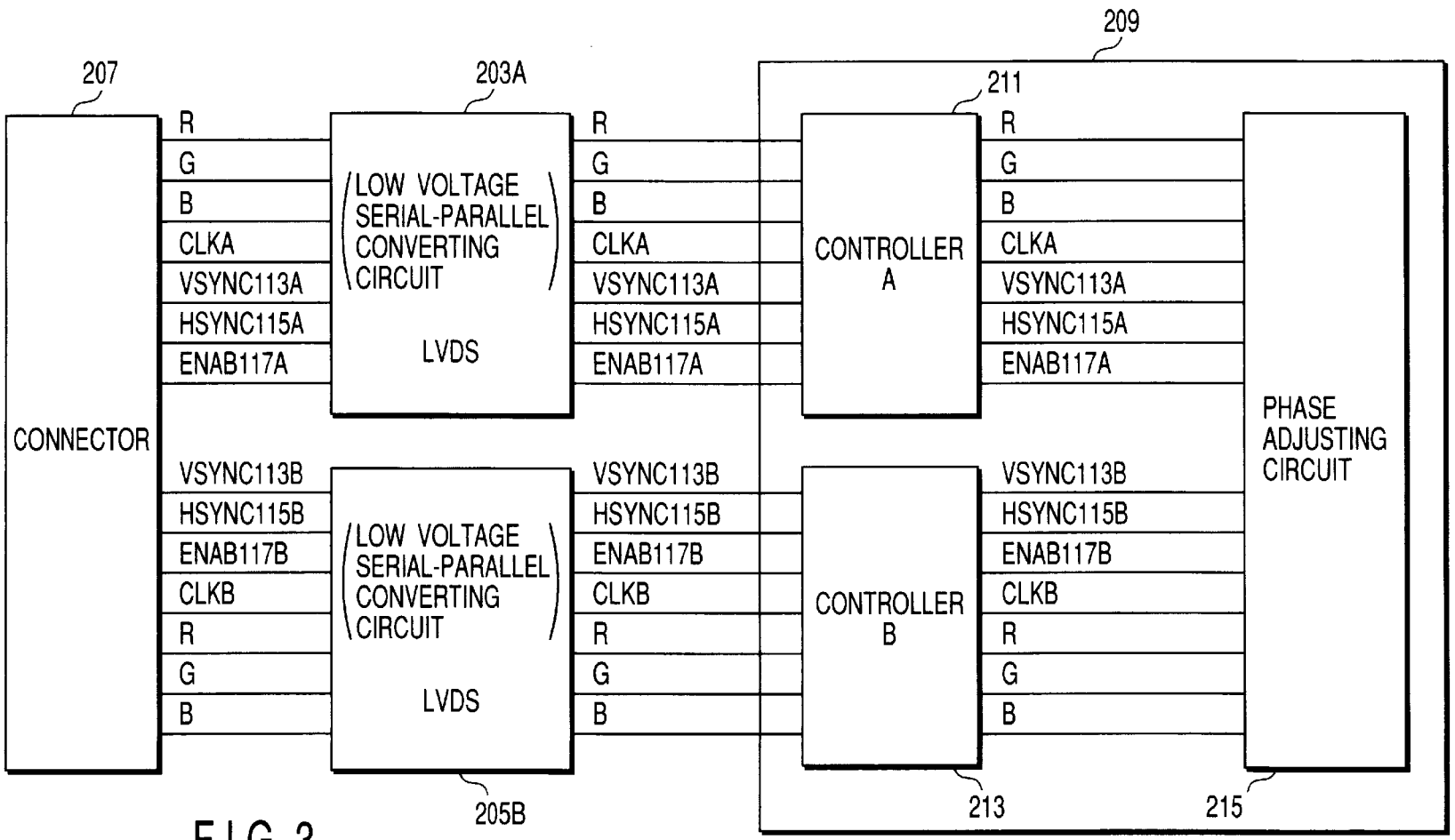
FIG. 3 is a diagram illustrating a skew adjustment mechanism that a panel control gate array 209 has.

FIG. 3 is a diagram illustrating a skew adjusting mechanism that the panel control gate array 209 has.

In FIG. 3, a panel control gate array 209 includes a controller A211, a controller B213, and a phase adjusting circuit 215. One of the features of the panel control gate array 209 is that skew adjustment between transmission channels is carries out with respect to a control signal as well as a display signal.

The controller A211 is an interface that inputs a display signal 110A and a control signal A. The controller B213 is an interface that inputs a display signal 110B and a control signal B.

The phase adjusting circuit 215 inputs a display signal, a control signal, and a CLK signal from each controller, and carries out skew adjustment. That is, the phase adjusting circuit 215 adjusts a deviation in phase between signals each inputted to the panel control gate array 209 via each transmission channel based on the CLK signal 111A and CLK signal 111B. Then, a top panel X driver, a bottom panel X driver, and a Y driver (not shown) are driven at a variety of timing signals, and the display data read in each shift register in the top panel X driver and bottom panel X driver is outputted onto an LCD panel.

The above variety of timing signals includes HSYNC corresponding to one line cycle, VSYNC corresponding to one screen cycle, and a shift clock (SCK) for reading data into each of the shift registers in the top panel X driver and bottom panel X driver.

The LCD panel is composed of top and bottom panels, where a signal line outputted from the top panel X driver, a signal line outputted from the bottom panel X driver, and a signal line outputted from the Y driver 59 are wired in a matrix shape. The LCD panel selects a specific line on the LCD panel with a shift clock pulse generated in the Y driver, supplies data outputted via the corresponding signal line from the top panel X driver and bottom panel X driver to the respectively selected pixels, and displays the supplied data on the screen.

Now, an operation of a display system configured above will be described with reference to FIG. 2 and FIG. 3. Dotted line frames A and B in the figures each indicate two different transmission channels A and B for transmitting a signal generated by the display controller 101 to a gate array 209 in the panel.

As has already been described, one of the important points of the present invention is a technical idea that divides a signal generated by the display controller into a plurality of signal groups comprising a display data signal, a control signal, and a clock signal, transmits the divided signals to the panel controller via the channels that differ with each signal group, and executes adjustment of a skew generated between signals with respect to a control signal.

That is, a signal group A comprising a digital display signal 110A that configures part of a digital display signal 110 generated by the display controller 101, a control signal A that corresponds to the digital display signal 110A and that configures part of the control signal (i.e., a VSYNC signal 113A, an HSYNC signal 115A, and an ENAB signal 117A), and a CLK signal 111A is transmitted to the panel internal gate array 209 via a transmission channel A.

In addition, a signal group B comprising a digital display signal 110B that configures the residual digital display signal 110, a control signal B that corresponds to the digital display signal 110B and that configures part of a control signal (i.e., a VSYNC signal 113B, an HSYNC signal 115B, and an ENAB signal 117B), and a CLK signal 111B is transmitted to the panel internal gate array 209 via a transmission channel B.

In general, a skew may occur between each signal via the transmission channel A and each signal via the transmission channel B. This skew causes a serious problem as the display mode resolution is higher.

This display system adjusts a skew generated between signals inputted via the different transmission channel at the phase adjusting circuit 215 in the panel controller 20 by obtaining synchronization by means of a latch or the like. Therefore, with respect to the digital display signal 110 and control signal outputted from the phase adjusting circuit 215, it is possible to eliminate a skew generated in data transmission from the main frame of the computer 1 to the flat panel 20, and proper image display can be carried out.

With the above described configuration, the following advantageous effect can be achieved.

This display system transfers display signals, control signals and the like in a serial manner at a high speed at a plurality of LVDS-ICs from the display controller 10 to the flat panel display 20. Therefore, this display system is compatible with any display panel with high resolution. In addition, when the plurality of LVDS-ICs are used, a skew between control signals frequency divided at each LVDS-IC is adjusted. Therefore, proper display control is possible on any display panel with high resolution.

This display system transfers a display signal, a control signal, and a clock signal in an analog serial manner at a low voltage from the display controller 10 to the flat display 20 by using a plurality of LVDS-ICs. Therefore, a signal amplitude can be reduced, thereby making it possible to eliminate an electromagnetic interference. Particularly, the display system brings remarkable reduction of the electromagnetic interference for the notebook size personal computer since the display device is built in the notebook size personal computer body, and the many radiation of electromagnetic wave occur.

The present invention has been described above by way of showing embodiments. Various modifications and alterations can occur to one skilled in the art within the scope of idea of the present invention. It is understood that these modifications and alterations pertain to the scope of the present invention. For example, as shown below, various modifications can occur without departing from the spirit of the invention.

In the above described embodiment, two LVDS-ICs are provided, respectively, at the computer main frame side and flat panel side, and the signals each are transmitted to be diverged into two transmission channel A and B. Further, three or more transmission channels may be provided in order to correspond to a display mode with a high frequency. In this case as well, of course, an advantageous effect similar to the above embodiment can be achieved by eliminating a skew generated between signals at the phase adjusting circuit 215.

The above embodiment includes the invention at various stages, and various inventions can be excerpted by using a proper combination of a plurality of constituent elements disclosed. In addition, the embodiments each may be carried out by combining them to its required maximum, and in this case, the combined effect can be achieved. Further, the above embodiments include inventions at a variety of stages, and a variety of inventions can be extracted by properly combining a plurality of constituent elements disclosed. For example, even if some constituent elements are erased from all the constituent elements shown in the embodiment, in the case where the problems described in the Background of the Invention section can be solved, and at least one of the advantageous effects described in the Detailed Description of the Invention section is achieved, a configuration from which these constituent elements are erased can be excerpted.

According to the above described configuration, there can be provided a panel display system with high resolution and an information processing apparatus capable of reducing a skew with the transmission LVDS.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A display system comprising:

a display device;

a generator configured to generate an image data signal that is a parallel signal of plural bits and a control signal concerning horizontal synchronization and vertical synchronization;

a first transmission device which converts part of the image data signal into a first serial signal and transmits the first serial signal and a first control signal corresponding to the part of the image data signal from said generator to said display device; and a second transmission device which is separate from said first transmission device, converts a rest of the image data signal into a second serial signal and transmits the second serial signal and a second control signal corresponding to the rest of the image data signal from said generator to said display device;

wherein said display device converts the first serial signal into the part of the image data signal and the second serial signal into the rest of the image data signal, and adjusts a skew between the part of image data signal and the rest of the image data signal based on the first and second control signals.

2. The display system according to claim 1, wherein the control signal includes a clock signal.

3. The display system according to claim 1, wherein said first transmission device decreases a potential of the first serial signal lower than a potential of the part of the image data signal; and said second transmission device decreases a potential of the second serial signal lower than a potential of the rest of the image data signal.

4. The display system according to claim 3, wherein the potential of the image data signal is at a CMOS/TTL level, and the potential of the first serial signal and the potential of the second serial signal are less than 1 volt.

5. The display system according to claim 1, wherein said display device is displayable with resolution of 1024 dots× 768 lines or more.

6. The image display system according to claim 1, wherein said first transmission device includes a serial transfer channel to transmit the first serial signal; and said second transmission device includes a serial transfer channel to transmit the second serial signal.

7. The display system according to claim 1, wherein said display device adjusts a skew between the first control signal and the second control signal.

8. A display system comprising:

a display device;

a generator configured to generate an image data signal that is a parallel signal of plural bits and a parallel control signal concerning horizontal synchronization and vertical synchronization;

a first transmission device which converts part of the image data signal into a first serial image data signal and a first control signal corresponding to the part of the image data signal into a first serial control signal, and transmits the first serial image data signal and first serial control signal from said generator to said display device; and a second transmission device which is separate from said first transmission device, converts a rest of the image data signal into a second serial image data signal and a second control signal corresponding to the rest of the image data signal into a second serial control signal, and transmits the second serial image data signal and second serial control signal from said generator to said display device;

wherein said display device converts the first serial image data signal into the part of the image data signal, the second serial image data signal into the rest of the image data signal, the first serial control signal into the first control signal corresponding to the part of the image data signal, and the second serial control signal into the second control signal corresponding to the rest of the image data signal, and adjusts a skew between the part of image data signal and the rest of the image data signal based on the first and second control signals.

9. The display system according to claim 8, wherein the control signal includes a clock signal.

10. The display system according to claim 8, wherein said first transmission device decreases a potential of the first serial image data signal lower than a potential of the part of the image data signal; and said second transmission device decreases a potential of the second serial image data signal lower than a potential of the rest of the image data signal.

11. The display system according to claim 10, wherein the potential of the image data signal is at a CMOS/TTL level, and the potential of the first serial image data signal and the potential of the second serial image data signal are less than 1 volt.

12. The display system according to claim 8, wherein said display device is displayable with resolution of 1024 dots× 768 lines or more.

13. The image display system according to claim 8, wherein said first transmission device includes a serial transfer channel to transmit the first serial signal; and said second transmission device includes a serial transfer channel to transmit the second serial signal.

14. The display system according to claim 8, wherein said display device adjusts a skew between the first control signal and the second control signal.

15. An information processing apparatus comprising:

a generator configured to generate an image data signal that is a parallel signal of plural bits and a control to generate an image data signal that is a parallel signal of plural bits and a control signal concerning horizontal synchronization and vertical synchronization:

a first transmission device which converts part of the image data signal into a first serial signal and transmits the first serial signal and a first control signal corresponding to the part of the image data signal from said generator to a display device; and a second transmission device which is separate from said first transmission device, converts a rest of the image data signal into a second serial signal and transmits the second serial signal and a second control signal corresponding to the rest of the image data signal from said generator to the display device, wherein said display device converts the first serial signal into the part of the image data signal and the second serial signal into the rest of the image data signal and adjusts a skew between the part of image data signal and the rest of the image data signal based on the first and second control signals.

* * * * *